US005372740A

United States Patent [19]

Fair et al.

[11] Patent Number: 5,372,740

[45] Date of Patent: Dec. 13, 1994

[54] HOMOGENEOUS LIQUID AUTOMATIC DISHWASHING DETERGENT COMPOSITION BASED ON SODIUM POTASSIUM TRIPOLYPHOSPHATE

[75] Inventors: Michael J. Fair, Saddle Brook; John R. Nicholson, Ramsey, both of N.J.

[73] Assignee: Lever Brothers Company, Division of Conopco, Inc., New York, N.Y.

[21] Appl. No.: 116,421

[22] Filed: Sep. 3, 1993

[51] Int. Cl.[5] ..... C11D 3/06; C11D 3/37; C11D 3/395; C11D 17/00

[52] U.S. Cl. ..... 252/135; 252/94; 252/99; 252/156; 252/173; 252/174.13; 252/174.24; 252/DIG. 14

[58] Field of Search ..... 252/135, 156, 174.24, 252/DIG. 14

[56] References Cited

U.S. PATENT DOCUMENTS

| | | | |
|---|---|---|---|
| 3,332,882 | 7/1967 | Blumbergs | 252/99 |
| 3,671,440 | 6/1972 | Sabakelli et al. | 252/103 |
| 3,673,098 | 6/1972 | Sabakelli et al. | 252/156 |
| 3,793,212 | 2/1974 | Gray et al. | 252/99 |
| 3,812,045 | 5/1974 | Gray | 252/99 |
| 4,128,494 | 12/1978 | Schirmann et al. | 252/95 |
| 4,153,569 | 5/1979 | van den Brom | 252/109 |
| 4,228,043 | 10/1980 | van den Brom | 252/529 |
| 4,298,492 | 11/1981 | van den Brom | 252/97 |
| 4,390,441 | 6/1983 | Beavan | 252/96 |
| 4,464,281 | 8/1984 | Rapisarda et al. | 252/174.21 |
| 4,752,409 | 6/1988 | Drapier et al. | 252/94 |
| 4,836,948 | 1/1989 | Corring | 252/99 |
| 4,859,358 | 8/1989 | Gabriel et al. | 252/99 |
| 4,941,988 | 7/1990 | Wise | 252/99 |
| 4,973,419 | 11/1990 | Romeo et al. | 252/135 |
| 4,988,456 | 1/1991 | Takahashi et al. | 252/314 |
| 5,019,290 | 5/1991 | Bruegge et al. | 252/135 |
| 5,200,236 | 4/1993 | Lang et al. | 427/213 |
| 5,213,706 | 5/1993 | Rapisarda et al. | 252/135 |

FOREIGN PATENT DOCUMENTS

| | | |
|---|---|---|
| 844481 | 6/1970 | Canada . |
| 68/6344 | 9/1962 | Somalia . |
| 836988 | 6/1960 | United Kingdom . |
| 855735 | 12/1960 | United Kingdom . |
| 907356 | 10/1962 | United Kingdom . |
| 907358 | 10/1962 | United Kingdom . |
| 907950 | 10/1962 | United Kingdom . |
| 1003310 | 9/1965 | United Kingdom . |
| 1246339 | 9/1971 | United Kingdom . |
| 2007253 | 5/1979 | United Kingdom . |

*Primary Examiner*—Paul Lieberman
*Assistant Examiner*—A. Hertzog
*Attorney, Agent, or Firm*—A. Kate Huffman

[57] ABSTRACT

A stable homogeneous liquid detergent composition based on sodium potassium tripolyphosphate, which is either formed in situ or preneutralized, and ortho- or pyrophosphates is described. The composition contains sodium and potassium ions in a $K^+/Na^+$ weight ratio of about 0.5 to less than about 1.5, and contains no added alkali silicate.

20 Claims, No Drawings

HOMOGENEOUS LIQUID AUTOMATIC DISHWASHING DETERGENT COMPOSITION BASED ON SODIUM POTASSIUM TRIPOLYPHOSPHATE

FIELD OF THE INVENTION

This invention relates to automatic dishwashing detergent compositions containing sodium potassium tripolyphosphate builders and ortho- or pyrophosphates and mixtures thereof.

BACKGROUND OF THE INVENTION

Sodium trimetaphosphate in combination with a potassium hydroxide base has been described as a useful builder in homogeneous automatic dishwashing compositions. See U.S. Pat. No. 5,213,706 issued to Rapisarda et al. on May 25, 1993. The combination of this builder with a potassium hydroxide base avoids the use of additional potassium salts to solubilize the alkaline components of the compositions and further avoids the undesirable reaction of other bases with the metaphosphate anion.

When sodium trimetaphosphate is combined with potassium hydroxide, the builder is hydrolyzed in situ to form a soluble sodium/potassium tripolyphosphate (SKTP) having the following formula:

$$(NaPO_3)_3+2KOH=Na_3K_2P_3O_{10}+H_2O$$

It was subsequently discovered that detergent compositions containing SKTP exhibited precipitation of tripolyphosphate salts causing spotting on machine and dishware surfaces. The precipitate problem is especially pronounced when the detergent compositions do not contain an alkali silicate and are formulated at a pH of below about 10.

SUMMARY OF THE INVENTION

It is therefore an object of the present invention to obtain a stable, readily dispensable and homogeneous detergent composition containing SKTP without exhibiting undesirable phosphate precipitates.

A further object of the invention is to provide an automatic dishwashing composition which is stable without the presence of an alkali silicate and at relatively low alkaline conditions.

Another object is to provide a detergent composition which further compatibilizes a nonionic surfactant and a source of available chlorine.

Finally, it is an object of the present invention to provide a homogeneous soluble gel composition in which the builder is cost effective and undesirable precipitation in the wash is avoided.

The objects of the present invention are ,accomplished by providing an inventive liquid detergent composition comprising from about 5 to about 28 wt. % sodium trimetaphosphate; from about 3 to about 12 wt. % potassium hydroxide; from about 1 to about 10 wt. % orthophosphate, pyrophosphate or mixtures thereof, and water.

Optional ingredients such as thickeners, stabilizers, bleach, nonionic surfactants, cobrants, dyes, pigments, perfumes, antitarnish agents, antiscalants, soil suspending agents, enzymes, hydrotropes and mixtures thereof are also included.

DETAILED DESCRIPTION OF PREFERRED EMBODIMENTS

The term "homogeneous" used to describe the inventive gel detergent means a detergent composition in which substantially all of the alkaline components are soluble in the liquid phase with no sedimentation occurring.

The term "sodium potassium tripolyphosphate" and its acronym "SKTP" refers to a tripolyphosphate compound having any mix of sodium to potassium counterions suitable for the invention. Especially useful compounds include tri- or tetrasodium di- or monopotassium tripolyphosphate.

Sodium trimetaphosphate reacts in situ with potassium hydroxide to form a soluble sodium potassium tripolyphosphate (SKTP) as discussed in the Background.

Other sources of SKTP, rather than the in situ reaction source, may be used to form the compositions of the invention. In particular, SKTP supplied by Monsanto Chemical Company of St. Louis, Mo. is useful. When SKTP is the builder source, it should be present in an amount of about 5 to 40 wt. %, preferably 7 to 35 wt. %, most preferably 20 to 35 wt. %. Precipitates also form when detergent compositions based on preformed SKTP without the claimed phosphates of the invention is used.

Sodium trimetaphosphate is preferably used in an amount of about 5 to about 28% by weight, more preferably about 8 to 25% by weight, especially 15 to 23% by weight of the composition. The potassium hydroxide base is present in an amount of about 3 to about 12% by weight, preferably about 4 to about 10% by weight and especially preferred about 6 to about 8% by weight of the composition.

Ortho- or pyrophosphate, their corresponding salts, and mixtures thereof, are essential to the composition to avoid undesirable product precipitation. The phosphates should be present in an amount of from about 1 to about 10 wt. %, preferably about 1 to about 5 wt. % most preferably from about 1 to about 3 wt. % of the composition.

The sodium salt forms of ortho- and pyrophosphate are preferred. Sodium pyrophosphate is especially preferred. Commercially available sources of the phosphates include Monsanto Chemical Company of St. Louis, Mo.

The pH of the detergent compositions should be in a range of from 7 to 13; preferably from 7 to 10 (especially with enzymes present); more preferably 8 to 10.

When the SKTP is formed in situ, the preferred reaction is carried out by slurrying, the sodium trimetaphosphate with water in a tank or mixing vessel. Potassium hydroxide is added in solid or aqueous form. If the aqueous form is used, it should be heated to about 45° C. The rate of addition of the potassium hydroxide should be controlled so that the temperature in the mixing vessel is between about 45° and about 70° C. Processes involving the reaction of sodium trimetaphosphate with alkali are discussed in the following art: Netherlands No. 137,679 describes drying of SKTP/alkali with other ingredients; German No. 91,471 describes reacting sodium trimetaphosphate with alkali at a temperature of between 60° to 100° C. to simultaneously produce crystal and product and mother liquor; and U.S. Pat. Nos. 3,812,045 and 3,793,212 describe the reaction of sodium metaphosphate and alkali in the presence of anionic surfactants.

The composition contains potassium and sodium ions in a wt. ratio of $K^+/Na_+$ of less than about 1.5, and preferably from about 0.5 to about 1.0. It was surprisingly found that there was sufficient solubility of the alkaline components without the addition of potassium salts as a source of potassium to produce a useful product which remained stable for an extended period of time.

Surfactants

Nonionic surfactants which are hypohalite stable are generally preferred for use in automatic dishwasher detergents. Preferably, they should be of the low foaming type. Where appropriate, they can be used in an amount of from about 0.2 to about 8%, preferably from about 1 to about 4%. Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of the various chemical types suitable as nonionic surfactants include: polyoxyethylene and/or polyoxypropylene condensates of aliphatic carboxylic acids, aliphatic alcohols and alkyl phenols; polyoxyethylene derivatives of sorbitan mono- ,di-, and tri-fatty acid esters and polyoxyethylene-polyoxypropylene block polymers as described in U.S. Pat. No. 4,973,419, herein incorporated by reference.

The incompatibility of many alkoxylated nonionics with chlorine bleach must be taken into consideration when liquid and gel compositions are formulated. Attempts have been made to improve compatibility of alkoxylated nonionics and chlorine bleach by "capping" the terminal hydroxyl group, as described in U.S. Pat. Nos. 4,859,358 (Gabriel), and U.S. Pat. No. 4,988,456 (Takahashi) herein incorporated by reference.

Two alternative means of compatibilizing alkoxylates and chlorine bleach are: (1) to separate them in different compartments within a container for storage, and provide a means to combine them when they are dispensed for use, or (2) to encapsulate one of the materials. Encapsulation of chlorine bleach is preferably used in the present invention and is described more fully in the section on bleaches.

Since the nonionic is compatible with chlorine bleach in this invention, a wide variety of alkoxylates may be used. Particularly preferred are the low foaming nonionics such as those given in U.S. Pat. No. 4,973,419 in column 6, lines 28–50, herein incorporated by reference.

Bleach

A wide variety of halogen arid peroxygen bleach sources may be used in the present invention. Examples of such halogen and peroxygen bleaches are described in U.S. Pat. No. 5,200,236 issued to Lang et al., herein incorporated by reference.

Among suitable reactive chlorine or bromine oxidizing materials are heterocyclic N-bromo and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5,5-dimethylhydantoin are also quite suitable.

Dry, particulate, water-soluble anhydrous inorganic salts are likewise suitable for use herein such as lithium, sodium or calcium hypochlorite and hypobromite. Chlorinated trisodium phosphate is another core material. Chloroisocyanurates are, however, the preferred bleaching agents. Potassium dichloroisocyanurate is said by Monsanto Company as ACL-59®. Sodium dichloroisocyanurates are also available from Monsanto as ACL-60®, and in the dihydrate form, from the Olin Corporation as Clearon CDB-56®, available in powder form (particle diameter of less than 150 microns); medium particle size (about 50 to 400 microns); and coarse particle size (150–850 microns). Very large particles (850–1700 microns) are also found to be suitable for encapsulation.

Organic peroxy acids and diacyl peroxides may be utilized as the bleach core. The peroxy acids usable in the present invention are solid compounds and substantially stable in the temperature range of about 40° C. to about 50° C.

Typical monoperoxy acids useful herein include alkyl peroxy acids and aryl peroxy acids such as:

(i) peroxybenzoic acid and ring-substituted peroxybenzoic acids, e.g. peroxy-alpha-naphthoic acid, and magnesium monoperphthalate (ii) aliphatic and substituted aliphatic monoperoxy acids, e.g. peroxylauric acid, peroxystearic acid, 6-(N-phthalimido)peroxyhexanoic acid and o-carboxybenzamidoperoxyhexanoic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxyisophthalic acid (vi) 2-decyldiperoxybutane-1,4-dioic acid.

A typical diacylperoxide useful herein includes dibenzoylperoxide.

Inorganic peroxygen compounds may also be suitable as cores for the particles of the present invention. Examples of these materials are salts of monopersulfate, perborate monahydrate, perborate tetrahydrate, and percarbonate.

Bleach sources preferred for use in the present invention are those which can be encapsulated by the processes disclosed in U.S. Pat. No. 5,200,236 (Lang et al.) herein incorporated by reference.

Particularly preferred chlorine bleach sources include potassium, and sodium dichloroisocyanurate dihydrate. They should be present at a level which provides about 0.2 to about 1.5% available chlorine. Hypohalite liberating compounds may also be employed in the inventive dishwashing detergents at a level of from 0.5 to 5% by weight, preferably from 0.5 to 3%.

Some types of bleaches are not suitable for the present invention. For example, U.S. Pat. No. 4,390,441 discloses a composition which contains a halite, e.g., $NAClO_2$, which is relatively ineffective under alkaline conditions and must be irradiated with ultra violet radiation.

Peroxygen Bleach Precursors

Peracid precursors, preferably in granular form of size from 100 to 2,500 microns, preferably 500 to 1,500 microns are also suitable as cores for the particles of the present invention. Peracid precursors are compounds which react in the bleaching solution with hydrogen peroxide from an inorganic peroxygen source to generate an organic peroxy acid. They are also susceptible to hydrolysis, and cannot normally be formulated directly into aqueous cleaning compositions. Encapsulated peracid precursors would be incorporated into products along with a source of hydrogen peroxide, which also could optionally be encapsulated.

Peracid precursors for peroxy bleach compounds have been amply described in the literature, including in British Nos. 836,988; 855,735; 907,356; 907,358; 907,950; 1,003,310 and 1,246,339; U.S. Pat. Nos. 3,332,882 and 4,128,494; Canadian No. 844,481 and South African No. 68/6,344.

Typical examples of precursors are polyacylated alkylene aliamines, such as N, N, N', N'- tetraacetylethylene diamine (TAED) and N, N, N', N'-tetraacetylmethylene diamine (TAMD); acylated glycolurils, such as tetraacetylglycoluril (TAGU); triacetylcyanurate, sodium sulphophenyl ethyl carbonic acid ester, sodium acetyloxybenzene sulfonate (SABS), sodium nonanoyloxybenzene sulfonate (SNOBS) and choline sulfophenyl carbonate.

Peroxybenzoic acid precursors are Known in the art, e.g., from GB-A-836988. Examples thereof are phenylloenzoate; phenyl p-nitrobenzoate; o-nitrophenyl benzoate; o-carboxyphenyl benzoate; p-bromophenyl benzoate; sodium or potassium benzoyloxybenzenesulfonate; and benzoic anhydride.

Preferred peroxygen bleach precursors are sodium p-benzoyloxybenzene sulfonate, N, N, N', N'-tetracecetylethylene aliamine, sodium nonanoyloxybenzene sulfonate and choline sulfophenyl carbonate.

Thickeners and Stabilizers

Thickeners for use in the homogeneous compositions according to the invention are disclosed in U.S. Pat. No. 4,836,948 (Corring) herein incorporated by reference. Particularly preferred thickeners are the cross-linked polymers having molecular weights ranging from about 400,000 to about ten million, preferably between 400,000 and 4,000,000. Examples of commercially available cross linked polymers are the Carbopol® resins manufactured by the B. F. Goodrich Chemical Company. These material include Carbopol 627®, Carbopol 941® (m.w. 1,250,000) Carbopol 934® (m.w. 3,000,000), Carbopol 940® (m.w. 4,000,000) and Carbopol 617® (m.w. 4,000,000). Analogs provided by other manufacturers would also be useful. In the preferred embodiments, the chlorine bleach is encapsulated, thus polymers such as those disclosed in U.S. Pat. No. 4,260,528 (Fox et al.) may also be used.

The thickening polymer is present in the compositions in a range of 0 to about 3.0 by wt. and preferably about 0.4% to about 1.5% by wt.

Co-structurants or stabilizers may also be used in combination with the thickeners. Examples of such preferred co-structurants and stabilizers include (1) alumina described in U.S. Pat. No. 4,836,948, (2) alkali metal silico aluminate described in U.S. Pat. No. 4,941,988, (3) polyvalent metal soaps, described in U.S. Pat. No. 4,752,409 (Drapier, et al.) and (4) a synthetic hectorite clay such as Laponite XLS supplied by Waverly Mineral Products Co., subsidiary of LaPorte, Inc., of Bata Cynwd, Pa. 19004.

Preferred costructurants include alumina and the hectorite clays. The costructurants may be used in a range of from about 0.005 to 1%; preferably about 0.01 to about 0.5%; and especially preferred about 0.01 to about 0.1%.

Antiscalants

An anti-scalant agent inhibits the development of the microscopic nuclei to the critical size and then the agent redisperses to act on other nuclei. Antiscalant agents are also useful in broader applications such as in industrial boilers, water purification, evaporators, etc.

Any conventional anti-scalant (sometimes described as dispersant) which is used to prevent the deposition of sparingly soluble salt scale, such as $CaCO_3$ in water systems may be used in the invention.

Anti-scalant agents are available in either powder or solution form, generally solution form is available, and may be provided as acids, partially neutralized acids or otherwise contain a free acid. Examples of suitable phosphorus containing scale inhibitors include methylene phosphonates, methylene phosphonic acid, and other phosphates and phosphonates listed in McCutcheon's *Functional Materials,* North America Edition, Volume 2, McCutcheon Division Publishing, Glen Rock, N.J. (1991), herein incorporated by reference.

Preferred methylene phosphonates include pentasodium amino tris methylene phosphonate, hexamethylene diamine tetra methylene phosphonate, hexapotassium methylene phosphonate and octasodium diethylene triamine pentamethylene phosphonate.

Particularly preferred methylene phosphonic acids include diethylene triamine pentamethylene phosphonic acid. Especially preferred is hydroxy ethylidene diphosphonic acid in aqueous solution supplied as Arquest 710 by Aquaness Chemicals of Houston, Tex. or as Dequest 2010 by Monsanto of St. Louis, Mo. The same diphosphonic acid is available in powder form as Dequest 2016D by Monsanto or amino tris (methylene phosphonic acid) sold as Arquest 709 by Aquaness Chemicals. Polymeric anti-scalants suitable for the invention include polymaleic acid and its sodium salts (Belclene 200 and 201) supplied by Ciba-Geigy of Greensboro, N.C.), a polycarboxylate polymer series prepared from the copolymerization of acrylic and maleic acid sold under the Sokalan CP Series by BASF of Morristown, N.J., and sodium polyacrylates and polyacrylic acid available under the Sokalan PA Series supplied by BASF.

A polyacrylic acid and a sodium or ammonium polyacrylate are also suitable, such as products produced by Alco Chemical Corp., Division of National Starch and Chemicals, known as the Alcosperse Series, Colloids sold by Rhone-Poulenc Corp. of Dalton, Calif., Goodrite Series supplied by B. F. Goodrich of Cleveland, Ohio and Acusol Series supplied by Rohm & Haas of Philadelphia, Pa.

Particularly preferred anti-scalants include; Colloid 117/50; Colloid 211,223, 223(D) and 274; Good-rite K-732, K-752, K-7058, K-COON; Acusol 445 and AIcosperse 602N.

Additional anti-scalants available for the invention are described in Kirk-Othmer *Encyclopedia of Chemical Technology,* 3rd Edition, Volume 7, John Wiley & Sons, New York (1979), describing anti-nucleation agents or anti-scalants as dispersant materials.

A sulfonated styrene maleic anhydride copolymer is also a suitable anti-scalant for the invention and may De obtained as Versa TL 7 supplied by National Starch of Bridgewater, N.J. Other copolymers include Varlex D-82 supplied by National Starch and sodium lignosulfonates supplied under the trademark Orzans® by ITT Rayonier of Seattle, Wash.

Enzymes

Enzymes which are capable of facilitating removal of soils from a substrate are also suitable for the present invention. Such enzymes include proteases (e.g., Alcalase®, Savinase® and Esperase® from Novo Industries A/S), amylases (e.g. Termamyl® from Novo Industries A/S), lipases (e.g., Lipolase® from Novo Industries A/S) and oxidases. The enzymes are present in an amount of from 0.005 to 10%, preferably 0.005 to 5%.

Optional Ingredients

Bleach stable colorants such as Direct Yellow 28 and others disclosed in U.S. Pat. No. 5,089,162 issued Feb. 18, 1992 may be used in the present invention. Bleach sensitive dyes such as those described in U.S. Pat. No. 4,464,281 (Rapisarda, et al.) may also be used in the preferred embodiments containing encapsulated bleach. Alternatively, pigments such as Ultramarine Blue 5151 or Ultramarine Blue 17 may also be used. Greater latitude in the selection of perfume ingredients is provided because destabilization by chlorine is not a factor If additional defoaming is desired, silicones such as a polydimethyl siloxane with 6% hydrophobed silica supplied as Antifoam DB-100® by Dow Corning of Midland, Mich. may be used. Minor amounts of other ingredients such as anti-tarnish agents, soil suspending agents, hydrotropes, well-known enzyme stabilizers such as the polyalcohols, e.g. glycerol and borax, etc. may also be included in the inventive formulations. The amount of each optional additive is no greater than about 0.5% by weight.

The following examples will serve to distinguish this invention from the prior art, and illustrate its embodiments more fully. Unless otherwise indicated, all parts, percentages and proportions referred to are weight.

EXAMPLE 1

Compositions outside the scope of the invention were prepared as follows:

| | A | B | C |
|---|---|---|---|
| Sodium Trimetaphosphate | 19.0 | 23.0 | 26.0 |
| Potassium hydroxide | 8.3 | 10.0 | 11.3 |
| Carbopol 627[1] | 1.0 | 1.0 | 1.0 |
| Glycerin | 6.0 | 6.0 | 6.0 |
| Sodium tetraborate | 3.0 | 3.0 | 3.0 |
| Sodium sulfite | 0.1 | 0.1 | 0.1 |
| Wax encapsulates (1.2% available chlorine) | 4.3 | 4.3 | 4.3 |
| Nonionic[2] | 2.0 | 2.0 | 2.0 |
| Enzymes | 0.8 | 0.8 | 0.8 |
| Water | to 100% | to 100% | to 100% |

-continued

| | A | B | C |
|---|---|---|---|
| $K^+/Na^+$ Ratio (wt. %) | 1.24 | 1.24 | 1.26 |

[1]a synthetic polymer having a molecular weight of 400,000 supplied by B. F. Goodrich Co.
[2]alkoxylated nonionic supplied under the tradename Plurafac by BASF of New Jersey.

Example 1 (samples A, B and C) was prepared by first formulating a premix of water and Carbopol 627®. The sodium trimetaphosphate was then dispersed in the Carbopol® premix. While stirring, the; requisite amount of potassium hydroxide was added at a rate such that the temperature did not exceed 70° C. The glycerin, sodium tetraborate and sodium sulfite were added next, followed by the addition of the nonionic, Plurafac LF-403. Enzymes and the encapsulated chlorine source were incorporated after the batch temperature was cooled to less than 37° C.

The wax encapsulates were prepared with Boler® 1397 paraffin wax as described in Lang et al., 5,200,236, herein incorporated by reference.

Table 1 compares the potassium to sodium weight ratios for Samples A, B and C:

TABLE 1

| | % SEQUESTERING ANION | | | |
|---|---|---|---|---|
| | Ratio $K^+$ to $Na^+$ | Tripoly | Pyro | Ortho |
| A | 1.24 | 15.6 | 0 | 0 |
| B | 1.24 | 18.9 | 0 | 0 |
| C | 1.26 | 21.4 | 0 | 0 |

EXAMPLE 2

Example 2 (Samples A–G) was prepared as described above except the sodium ortho- and/or pyrophosphate were added to the mixture before the addition of the glycerin and tetraborate:

| | A | B | C | D | E | F | G |
|---|---|---|---|---|---|---|---|
| Sodium Trimetaphosphate | 23 | 23 | 23 | 23 | 23 | 23 | 21.5 |
| Potassium Hydroxide | 10 | 10 | 10 | 10 | 10 | 10 | 9.4 |
| Carbopol 627[1] | 1.0 | 1.0 | 1.0 | 1.0 | 1.0 | 1.0 | 1.0 |
| Glycerin | 6.0 | 6.0 | 6.0 | 6.0 | 6.0 | 6.0 | 6.0 |
| Sodium Tetraborate | 3.0 | 3.0 | 3.0 | 3.0 | 3.0 | 3.0 | 3.0 |
| Sodium Sulfite | 0.1 | 0.1 | 0.1 | 0.1 | 0.1 | 0.1 | 0.1 |
| Nonionic[2] | 2.0 | 2.0 | 2.0 | 2.0 | 2.0 | 2.0 | 2.0 |
| Enzymes | 0.8 | 0.8 | 0.8 | 0.8 | 0.8 | 0.8 | 0.8 |
| Wax Encapsulates (1.2% available chlorine) | 4.3 | 4.3 | 4.3 | 4.3 | 4.3 | 4.3 | 4.3 |
| Sodium Pyrophosphate | — | — | — | 3.0 | 5.0 | 2.0 | 3.0 |
| Sodium Orthophosphate | 1.0 | 3.0 | 5.0 | — | — | 2.0 | — |
| Water | to 100% | to 100% | to 100% | to 100% | to 100% | to 100% | to 100% |

[1]a synthetic polymer having a molecular weight of 400,000 supplied by B. F. Goodrich Co.
[2]alkoxylated nonionic supplied under the tradename Plurafac by BASF of New Jersey.

The potassium to sodium weight ratios for Samples A–G are tabulated below:

TABLE 2

| | RATIO $K^+$ TO $Na^+$ | % SEQUESTERING ANION | | | |
|---|---|---|---|---|---|
| | | TRIPOLY | PYRO | ORTHO | TOTAL |
| A | 1.20 | 18.9 | — | 0.25 | 19.15 |
| B | 1.14 | 18.9 | — | 0.75 | 19.65 |
| C | 1.07 | 18.9 | — | 1.25 | 20.25 |
| D | 1.12 | 18.9 | 1.2 | — | 20.10 |
| E | 1.05 | 18.9 | 2.0 | — | 20.90 |
| F | 1.09 | 18.9 | 0.8 | 0.5 | 20.20 |
| G | 1.12 | 17.7 | 1.2 | — | 18.90 |

EXAMPLE 3

A comparison of performance between the formulations of Example 1 and Example 2 were obtained as follows.

One of the criteria used to judge the performance of a dishwasher detergent is silverware and machine appearance after washing. In this example, eight stainless steel plates were placed in a Bosch® dishwasher. The minimum recommended amount of detergent was added to the dishwasher. After repeating the test through ten wash cycles, the stainless steel plates and machine interior were visually inspected and rated. The deposition of insoluble phosphate salts was rated numerically on a scale of 0 to 10 (0=best; 10=worst). Differences of about 1.0 are considered significant. The following results were obtained:

TABLE 3

Comparison of Performance Results Between Examples 1 and 2

| EXAMPLE | PRODUCT | PLATE AND MACHINE INTERIOR APPEARANCE |
|---|---|---|
| 1 | A | 10 |
| | B | 10 |
| | C | 5 |
| 2 | A | 3 |
| | B | 2 |
| | C | 5 |
| | D | 2 |
| | E | 2 |
| | F | 1 |
| | G | 3 |

It was observed that the compositions of the invention provided significantly better results than compositions based on sodium trimetaphosphate without the phosphates of the invention.

EXAMPLE 4

Formulations based on trisodium di-potassium tripolyphosphate (SKTP) were prepared as follows:

| | A | B |
|---|---|---|
| SKTP[1] | 30 | 28 |
| Carbopol 627[2] | 1.0 | 1.0 |
| Glycerin | 6.0 | 6.0 |
| Sodium Tetraborate | 3.0 | 3.0 |
| Sodium Sulfite | 0.1 | 0.1 |
| Nonionic[3] | 2.0 | 2.0 |
| Enzymes | 0.8 | 0.8 |
| Wax Encapsulates (1.2% available chlorine) | 4.3 | 4.3 |
| Water | to 100% | to 100% |
| Sodium pyrophosphate | — | 3.0 |

[1]preneutralized SKTP supplied by Monsanto Chemical Co. of St. Louis, MO.
[2]a synthetic polymer having a molecular weight of 400,000 supplied by B. F. Goodrich Co.
[3]alkoxylated nonionic supplied under the tradename Plurafac by BASF of New Jersey.

A premix of water and Carbopol® polymer was prepared. The SKTP was then dispersed in the Carbopol® premix. The glycerin, sodium tetraborate and sodium sulfite were added next, followed by the addition of the nonionic. Enzymes and the encapsulated chlorine source were incorporated after the batch temperature was cooled to less than 37° C.

The potassium to sodium weight ratios for samples A and B are tabulated in Table 4:

TABLE 4

| | RATIO K+ TO Na+ | % SEQUESTERING ANION | | | |
|---|---|---|---|---|---|
| | | TRIPOLY | PYRO | ORTHO | TOTAL |
| A | 1.05 | 18.4 | 0.6 | — | 19.0 |
| B | 0.93 | 17.2 | 1.7 | — | 18.9 |

EXAMPLE 5

The formulations of Example 4 were tested as described in Example 3 with the following results:

| EXAMPLE | PRODUCT | PLATE AND MACHINE INTERIOR APPEARANCE |
|---|---|---|
| 4 | A | 8 |
| | B | 2 |

The addition of sodium pyrophosphate to the formulation (Sample B) improved the performance significantly when compared with the results obtained from the preneutralized sodium potassium tripolyphosphate based formulation containing no added pyrophosphate (Sample A).

We claim:

1. A homogeneous liquid detergent composition comprising:

(a) about 5 to about 28% by weight of a sodium trimetaphosphate;

(b) about 3 to about 12% by weight of a potassium hydroxide base;

(c) 1 to about 5% by weight of an orthophosphate, pyrophosphate, corresponding salts of the orthophosphate and pyrophosphate or mixtures thereof;

(d) 0 to about 3.0% by weight of a thickening polymer; and (e) water, wherein the composition contains sodium and potassium ions in a $K^+/Na^+$ weight ratio of about 0.5 to less than about 1.5 and the composition contains no added alkali silicate.

2. A detergent composition according to claim 1 wherein the composition further comprises a bleaching effective amount of a bleaching agent.

3. A detergent composition according to claim 2 wherein the bleaching agent is a peroxygen or halogen agent.

4. A detergent composition according to claim 3 wherein the bleaching agent is a peroxygen agent selected from the group consisting of an alkyl peroxy acid and an aryl peroxy acid.

5. A detergent composition according to claim 4 wherein the aryl peroxy acid is selected from the group of 6-(N-phthalimido)peroxyhexanoic acid, o-carboxybenzamidoperoxyhexanoic acid and mixtures thereof.

6. A detergent composition according to claim 2 wherein the bleaching agent is a wax encapsulated bleach particle.

7. A detergent composition according to claim 6 wherein the wax encapsulated particle is composed of one or more paraffin waxes.

8. A detergent composition according to claim 3 wherein the halogen source is potassium or sodium dichloroisocyanurate dihydrate.

9. A detergent composition according to claim 1 wherein the pyrophosphate or its corresponding salts are present in an amount of about 1 to about 3 wt. %.

10. A detergent composition according to claim 1 wherein the sodium trimetaphosphate is present in an amount of about 8 to about 23 % by weight.

11. A detergent composition according to claim 1 wherein the thickening polymer has a molecular weight of between 400,000 and 4,000,000 and is present in an amount of about 0.4% by weight to about 1.5% by weight.

12. A detergent composition according to claim 1 further comprising about 0.2 to about 8% by weight of a nonionic surfactant.

13. A detergent composition according to claim 1 further comprising one or more optional additives selected from the group consisting of dyes, pigments, perfumes, anti-tarnish agents, soil suspending agents, hydrotropes and mixtures thereof, the amount of each additive being up to about 0.5 % by weight.

14. A detergent composition according to claim 1 having a pH in the range of about 7 to about 10.

15. A homogeneous liquid composition comprising:

(a) about 5 to about 40% by weight of a soluble sodium potassium tripolyphosphate;

(b) 1 to about 5% by weight of an orthophosphate, pyrophosphate, corresponding salts of the ortho- and pyrophosphate, or mixtures thereof;

(c) 0 to about 3.0% by weight of a thickening polymer;

(d) water, wherein the composition contains both sodium and potassium ions in a $K^+/Na^+$ weight ratio of about 0.5 to less than about 1.5 and contains no added alkali silicate.

16. A detergent composition according to claim 15 wherein the composition further comprises a wax encapsulated bleach source in a bleaching effective amount.

17. A detergent composition according to claim 16 wherein the bleach source is a halogen or peroxygen source.

18. A detergent composition according to claim 15 wherein the sodium potassium tripolyphosphate is present in an amount of 7–35% by weight.

19. A detergent composition according to claim 15 wherein the thickening polymer has a molecular weight of between 400,000 and 4,000,000 and is present in an amount of about 0.4% by weight to about 1.5% by weight.

20. A detergent composition according to claim 15 further comprising one or more optional additives selected from the group consisting of dyes, pigments, perfumes, anti-tarnish agents, soil suspending agents, hydrotropes and mixtures thereof, the amount of each additive being up to about 0.5% by weight.

* * * * *